United States Patent [19]

Klingaman

[11] 4,088,246

[45] * May 9, 1978

[54] CAPSULE AND CONTAINER THEREFOR

[75] Inventor: Richard James Klingaman, Darien, Conn.

[73] Assignee: Colgate-Palmolive Company, New York, N.Y.

[ * ] Notice: The portion of the term of this patent subsequent to Jun. 29, 1993, has been disclaimed.

[21] Appl. No.: 665,758

[22] Filed: Mar. 11, 1976

Related U.S. Application Data

[63] Continuation-in-part of Ser. No. 571,886, Apr. 25, 1975, Pat. No. 3,966,089.

[51] Int. Cl.[2] ..... B67B 7/24

[52] U.S. Cl. ..... 222/88; 222/541; 222/48

[58] Field of Search ..... 222/83.5, 88, 86, 80, 222/82, 81, 541; 206/222, 219, 303, 498; 215/100 R; 259/60, 48; 128/218 M, 272, 272.1, 272.3, DIG. 28

[56] References Cited

U.S. PATENT DOCUMENTS

| | | | |
|---|---|---|---|
| 850,070 | 4/1907 | Spikes | 222/400.7 |
| 1,120,170 | 12/1914 | Tompkins | 222/80 |
| 3,101,870 | 8/1963 | Betner | 222/541 |
| 3,434,629 | 3/1969 | Hooge et al. | 222/88 |
| 3,595,439 | 7/1971 | Newby et al. | 222/80 |
| 3,655,096 | 4/1972 | Easter | 206/222 X |
| 3,887,069 | 6/1975 | Diwo | 215/100 R X |
| 3,966,089 | 6/1976 | Klingaman | 222/88 |

*Primary Examiner*—Robert B. Reeves
*Assistant Examiner*—John P. Shannon
*Attorney, Agent, or Firm*—Strauch, Nolan, Neale, Nies & Kurz

[57] ABSTRACT

A capsule containing concentrated detergent liquid or like material has a frangible bottom wall. The capsule which preferably has stiff side walls and a considerable more frangible bottom wall may be mounted in a cradle in the upper or neck portion of a special dispensing container having a removable top closure and the body of which contains a diluent or like liquid such as water and is provided with one or more devices for puncturing the bottom wall of an inserted capsule. In a preferred form the capsule has an annular storage compartment. A formation of the upper end of the capsule coacts with the closure so that, after insertion of a fresh capsule, mounting of the closure upon the container body displaces the inserted capsule relative to the puncturing devices on the cradle to destroy the frangible bottom wall and empty the capsule contents into the body of the container. In one form the capsule may serve as the container closure.

8 Claims, 17 Drawing Figures

FIG.1
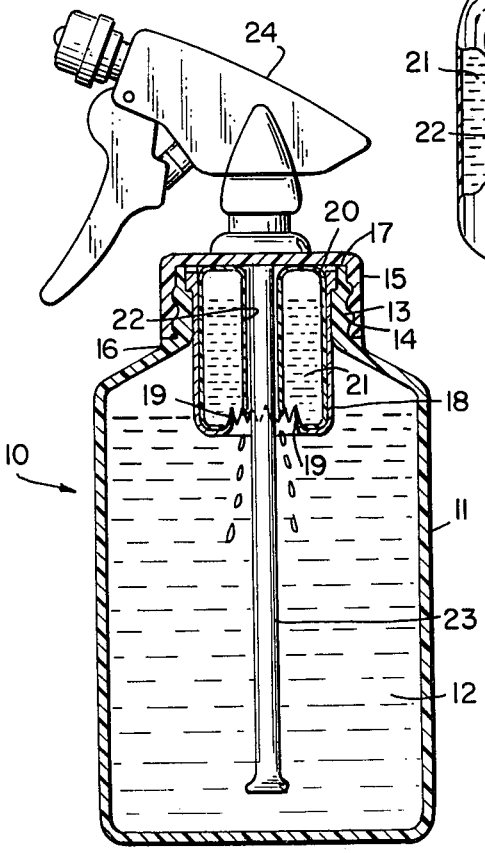
FIG.2
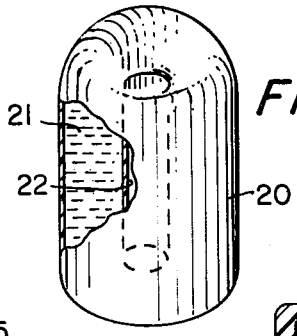
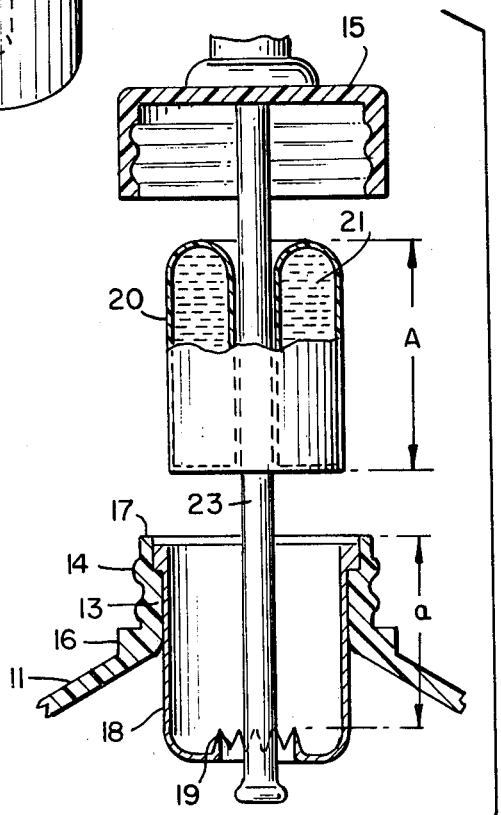
FIG.3
FIG.4
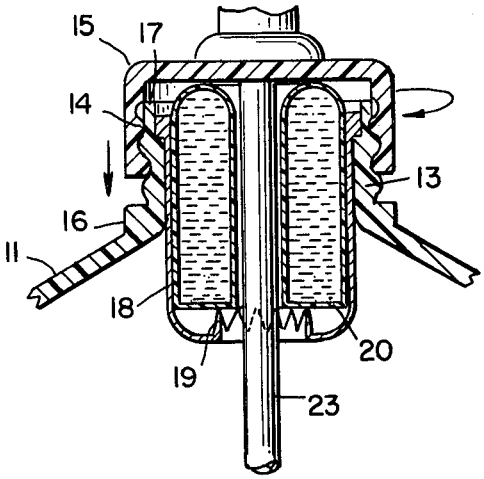

FIG. 16
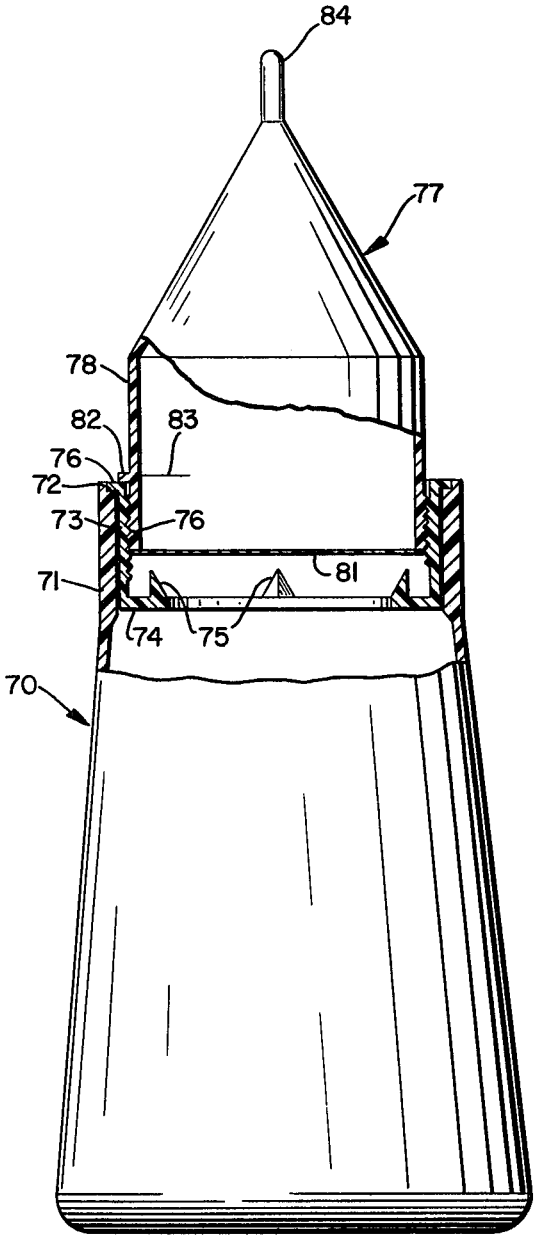
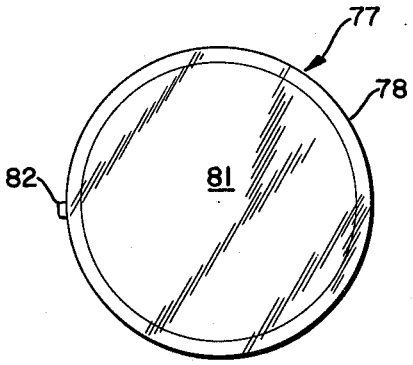
FIG. 17

CAPSULE AND CONTAINER THEREFOR

This is a continuation-in-part of Ser. No. 571,886 filed Apr. 25, 1975 for Diluting and Dispensing Container, now U.S. Pat. No. 3,966,089 issued June 29, 1976.

BACKGROUND OF INVENTION

The invention pertains to capsules for initial and replacement installation in a container for combining at least two separate components of a multi-component system that are to be combined before use and subsequently dispensed together as a functional solution. More specifically, the invention provides such capsules containing a concentrated material, typically a liquid detergent for combination with a liquid diluent, such as water, in the body of the container. After the combined solution of concentrated material and diluent is dispensed from the container, the spent capsule is removed and replaced by a fresh capsule.

In many instances it is desirable to retain the components of a multi-component system separate and to combine them shortly before use. This is true of systems wherein the components are incompatible either with each other or the packaging material, as well as when it is desired to supply the consumer with a concentrated substance which can be diluted, typically with water, to form a functional solution.

The present invention provides a novel capsule of a concentrated substance especially adapted for use in conjunction with a reusable dispenser container to combine the concentrated substance with a diluent material to form a functional solution. Typical of the concentrated substances usable according to the invention are detergents that can be subsequently diluted with water to form a detergent solution of the proper concentration for use as a window cleaner, spot remover, disinfectant cleanser for hard surfaces, i.e., tubs and tile cleaners, wall cleaners, etc. The invention also includes a novel resusable dispensing container particularly adapted for one embodiment of a capsule disclosed herein.

Dispensers for combining the components of a multi-component system shortly before use can be classified into two distinct groups. The first group are those employing resusable containers that can be recharged with a fresh capsule of concentrate when the functional solution is expended and a second group wherein the container and capsule of concentrate are designed for a single use and subsequent disposal. In the second group the capsule of concentrate is typically permanently contained within the container and/or dispenser.

Container-dispensers of the general type of the first class are disclosed in Easter U.S. Pat. No. 3,655,096.

The second class of multi-component container dispensers includes devices such as disclosed in Jeynes, Jr. U.S. Pat. No. 3,024,947, Smith U.S. Pat. No. 2,653,611 and Schwartman U.S. Pat. No. 3,347,410. Jeynes, Jr. also discloses an annular capsule punctured by rotation of a closure on the container neck.

SUMMARY OF THE INVENTION

The capsule of the invention containing the concentrate substance can have a ring or doughnut shaped cross sectional configuration with an annular concentrate storage compartment and a central passageway. The bottom wall of the capsule is of a frangible material and thickness adapted to be pierced or ruptured by puncturing means in or on the container in response to a downward force applied to the capsule while it is in place on the cradle and resting on the puncturing means.

As will appear the capsule in its preferred embodiments has stiff non-collapsible side walls that are appreciably less frangible than the bottom wall.

In the container with which the capsule is used, a closure cap including a dispensing means, typically a pump, or simply an orifice where the container is a squeeze bottle, is provided. The closure cap includes means to mate with the neck portion of the container to provide a tight seal between the two members. A dip tube communicating with the dispensing means can be associated with the closure cap. The length of the dip tube is chosen so that it terminates a short distance above the bottom of the body portion of the bottle. Alternately, the combined diluent and concentrate solution can be dispensed through the central passageway of the capsule and a dispensing orifice in response to finger pressure applied to the sides of the flexible wall bottle i.e. a squirt bottle. In this latter embodiment a dip tube may not be used since the central passageway of the capsule forms a suitable conduit for the solution to pass from the body of the bottle to the dispensing orifice.

The closure cap is joined to the neck portion of the bottle usually by screwing it onto the neck and, if present, the dip tube passes through the central passageway of the capsule and into the body of the bottle. Before the closure cap is fully seated on the neck of the container, an inner surface of the top of the cap contacts the upper surface of the capsule. The additional application of downward axial force to seat the closure cap forces the capsule downward against the puncturing means until the frangible bottom of the capsule is pierced and the concentrate flows into the diluent contained in the body of the bottom to form the desired functional solution. In preferred forms the capsule is coupled to the closure for rotation as the closure is mounted on the bottom to ensure that the puncturing means breaks open the bottom wall of the container. The solution is dispensed from the bottle through the dip tube and the dispensing orifice as a spray or a stream of liquid either in response to activation of a hand pump associated with the closure cap or finger pressure applied to the sides of the flexible wall of the body portion of the bottle.

In accordance with a specific aspect of the invention, the concentrate capsule is of a predetermined height dimension, measured parallel to the axis of the central passageway. The predetermined height dimension of the capsule is greater than the distance from the upper terminus of the puncturing means to the upper rim of the neck portion of the bottle. Accordingly, when the capsule is placed inside the neck portion and rests in the cradle on the puncturing means, a portion of the capsule extends beyond the upper rim of the neck portion of the bottle and projects from the container.

In further accordance with an important specific aspect of the invention, the predetermined height dimension of the capsule is chosen so that the top surface of the capsule is above the rim of the neck portion of the container after the bottom of the capsule is punctured. The distance of projection for the capsule beyond the rim of the neck portion of the container after the closure cap is fully seated should be sufficient to permit the capsule to be grasped between the fingers and withdrawn from the container. This feature of the invention allows the user of the dispenser-container to readily remove and disposed of a spent capsule since the projecting portion of the capsule can be grasped by the user. By providing a capsule with a frangible bottom and appropriate puncturing means in the neck of the container, the dispenser-container avoids possible splashback of the concentrate onto the user when the capsule is punctured, as might be the case with prior art systems of this type employing a replaceable cartridge that is punctured at the top as well as the bottom.

A primary advantage of the dispenser-container with replaceable capsule is the economic savings realized by the manufacturing, packaging, bulk storage and shipping cost of a concentrate solution rather than a dilute solution of active substances such as detergents. A further advantage is the reuseability of the container and dispensing mechanism with a multitude of capsules containing different types of concentrated active ingredients. A still further advantage of the invention is the provision of a container-dispenser of the foregoing type wherein the concentrate capsules are easily insertable and removable and do not interfere with the closure joint between the container and closure cap. A still further advantage of the new container is the elimination of possible back splashing of the concentrate solution out of the capsule when the concentrate and diluent are combined. An important feature of the invention is the provision of a novel concentrate capsule having relatively stiff side walls, a readily punctured bottom wall and preferably a formation in its top wall adapted for non-rotatable coupling with a rotatable container closure.

A further important feature is a special dispenser-container structure wherein a closure for the container is shaped to ensure uniform engagement with and form positive displacement of the capsule toward bottom wall puncturing means within the container.

Another important feature is a special capsule structure and mounting wherein the capsule also serves as the container closure.

Additional advantages and features of the invention will become apparent from the following description.

BRIEF DESCRIPTION OF THE DRAWINGS

The invention and preferred embodiments thereof will now be described in further detail with reference to the accompanying drawings in which:

FIG. 1 is a front elevational cross section view showing a capsule in a container-dispenser according to an embodiment of the invention;

FIG. 2 is an enlarged, perspective view of the capsule of FIG. 1, partially cut away to show detail;

FIG. 3 is an enlarged exploded fragmentary view partly in section showing the capsule and the neck portion of the container-dispenser of FIG. 1;

FIG. 4 is an enlarged cross sectional view of the neck portion of the container-dispenser of FIG. 1 with the closure can partially applied;

FIG. 16 is a side elevation in section showing a further embodiment wherein the capsule containing the concentrate or the like serves as the closure for the container; and FIG. 17 is a bottom plan view of the capsule of FIG. 16.

PREFERRED EMBODIMENTS

Figure 5:
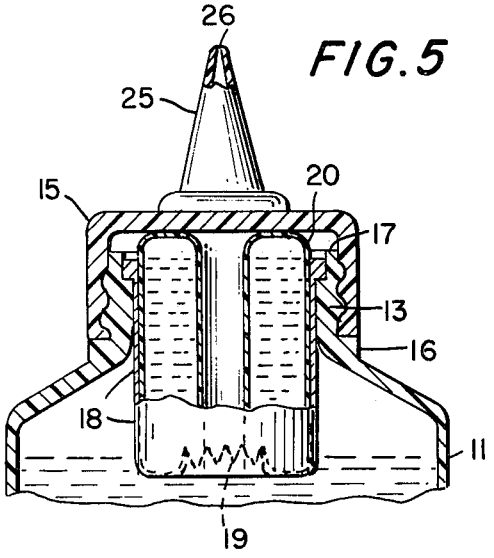
FIG. 5 is a cross sectional view showing the capsule of FIG. 1 mounted in the neck portion of another embodiment of the container-dispenser.

Referring to FIG. 1 of the drawings, the dispensing container of the invention is shown to include a bottle 10 or other hollow vessel having a body portion 11 for containing a diluent material 12 such as water, and a neck portion 13 having screw threads 14 on its outside surface for engaging the inner screw threads of closure cap 15, which is adapted to seal the open end of the neck portion 13 of the bottle 10. The closure cap 15 seats against the shoulder 16 disposed at the juncture of the body and neck portions of the bottle and can also seat against the outer rim 17 of the neck portion 13. However, and in accordance with a specific aspect of the invention, the closure cap may seat only against the shoulder 16 when the concentrate capsule is designed to protrude beyond the rim 17 when fully seated as shown in FIG. 5.

The neck portion 13 of the bottle 10 includes a cradle 18 attached to its inner surface and extending downwardly into the body portion 11 of the bottle. The cradle 18 terminates in upwardly extending puncturing means 19, typically in the form of a plurality of pointed projections in a circular saw tooth configuration.

A capsule of concentrated material 20, having an outside diameter slightly smaller than the inside diameter of the neck portion 13 is provided. The capsule 20 has the cross sectional configuration of a doughnut or a ring and includes an annular compartment 21 for the storage of the concentrated substance, typically a liquid, such as a detergent solution. A central passageway 22 passes through the capsule and provides a conduit for the dip tube 23 to extend from the hand pump 24 to the bottom region of the bottle. The capsule 20 has a frangible bottom wall adapted to be pierced by puncturing means 19 in response to downward axial movement of the closure cap 15. The remainder of the capsule 20, including the top wall can be substantially less frangible than the bottom wall.

The capsule 20 can be and preferably is injection molded from a plastic material such as polyethylene, polyvinyl chloride or many other suitable materials. The capsule is typically made in two sections with the top and side walls forming an integral molded unit and the frangible bottom wall being a thin plastic or cellulosic film either heat sealed or adhesively attached to the bottom of the side walls. In producing capsules, the integral top and side wall section is first molded. The concentrate solution is then supplied to the annular compartment 21 and the frangible bottom wall, comprising a thin film membrane, is heat sealed or adhesively secured over the open end of the capsule. The outer side wall of capsule 20 is preferably more stiff and less frangible than the bottom wall. Where crade 18 is cup-shaped it provides full side wall support and helps retain the capsule against lateral expansion during operational conditions as will appear.

Figure 6:
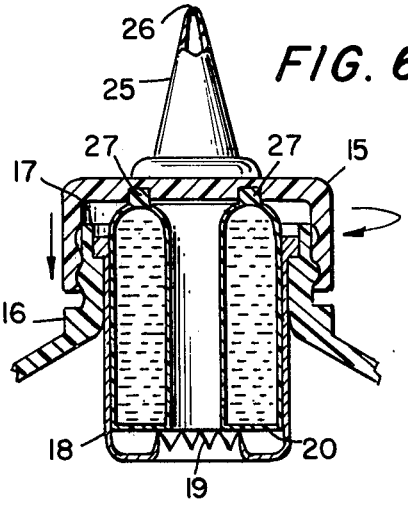
FIG. 6 is a cross sectional view showing a further form of capsule mounted in the neck portion of another embodiment of the container-dispenser.

Alternately, and as shown in FIGS. 5 and 6 of the drawings, a squirt nozzle 25 having a dispensing opening 26 can be used instead of the hand pump 24. When a squirt nozzle 25 is used in place of the hand pump 24 the walls of the bottle 11 should be flexible enough to permit the liquid contents to be expelled in response to finger pressure applied against opposing sides of the bottle.

As shown in FIG. 5, the capsule 20 can and preferably does protrude beyond the rim 17 of the neck portion 13 of the bottle when the cap 15 is seated against the shoulder 16. The protrusion of the capsule provides a surface which can be conveniently grasped by the consumer in removing a spent capsule from the container after use.

In any case, and according to a specific important aspect of the invention, the height or longitudinal dimension A of the capsule (see FIG. 3) should be greater than the distance (a) from the top of the projections 19 to the rim 17 of the neck portion 13 of the bottle. Most preferably the dimension A is chosen to result in the capsule extending beyond the rim 17 when the cap 15 is fully seated and the bottom of the capsule is punctured.

Figure 7:
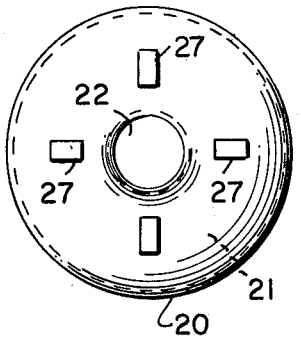
FIG. 7 is a top plan view of the concentrate capsule of FIG. 6.

Referring now to FIGS. 6 and 7, an alternate embodiment of the invention is shown. The capsule 20 can include a plurality of projections 27 extending from its upper surface and adapted to engage and mate with corresponding recesses in the upper surface of the closure cap 15. The engagement between projections 27 and the corresponding recesses causes the capsule 20 to rotate with the cap 15 while the cap is being screwed onto the neck portion 13 causing the bottom of the capsule to rotate on the puncturing means 19 while it is being punctured. As a result, the bottom of the capsule is ruptured to a greater extent thereby insuring that substantially all of the concentrate is released into the diluent 12.

Figure 8:
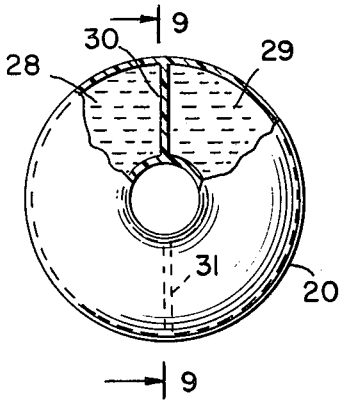
FIG. 8 is a partially cut away top plan view of another form of capsule.
Figure 9:
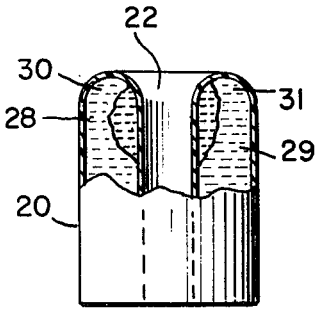
FIG. 9 is a cross sectional view of the capsule shown in FIG. 8, taken substantially along line 9—9 of FIG. 8.

Referring now to FIGS. 8 and 9 of the drawings, a further embodiment of the invention is illustrated. The capsule 20 shown in FIG. 8 includes a plurality of compartments 28, 29 for containing separate concentrated solutions that are to be combined with the diluent 12. The compartments 28, 29 are separated by partitions 30, 31 and are punctured simultaneously by puncturing means 19 when the closure cap 15 is applied.

Figure 10:
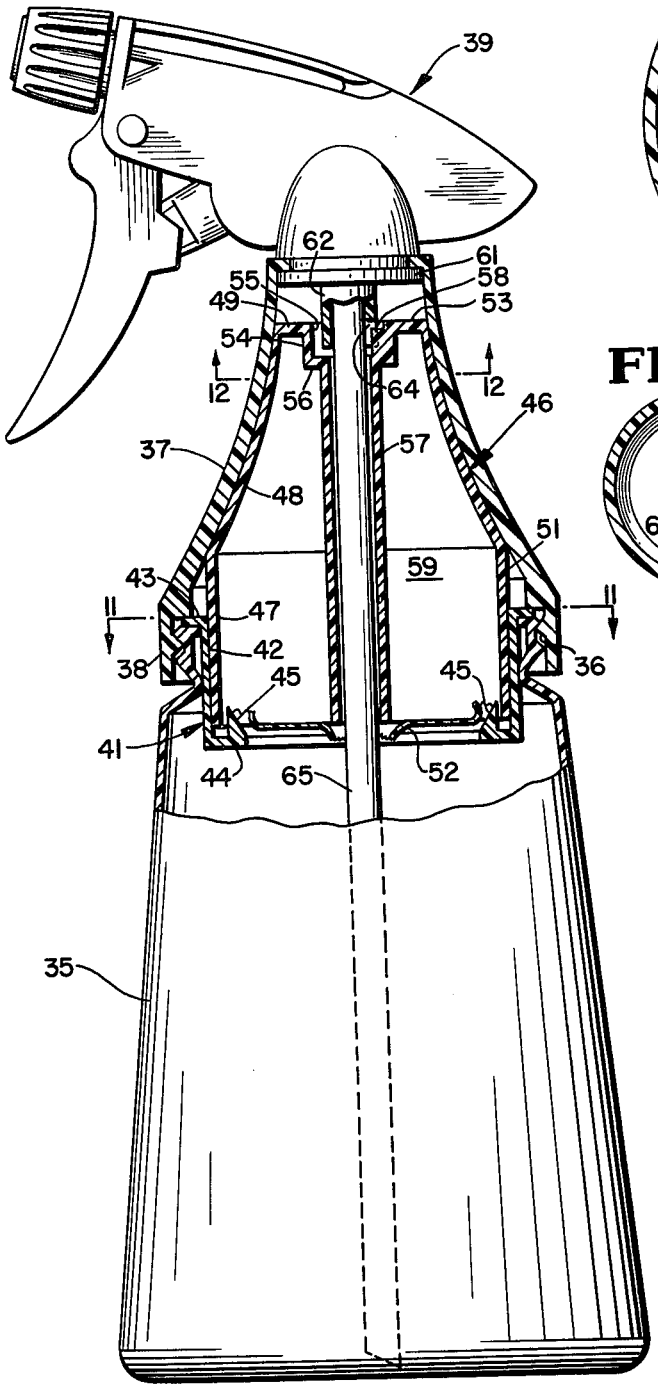
FIG. 10 is a side elevation, partly in section, showing another form of capsule in another embodiment of container-dispenser.
Figure 11:
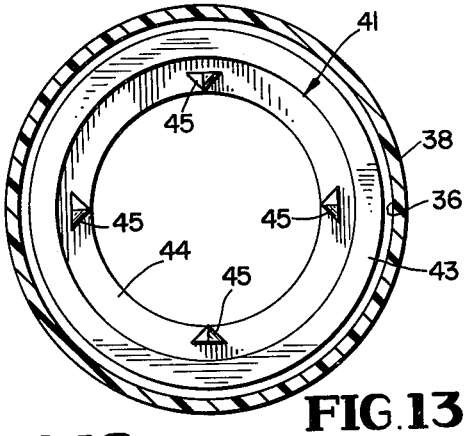
FIG. 11 is a section on line 11—11 of FIG. 10 affording a top plan view of the body of the container of FIG. 10 with the top closure and the capsule removed to show internal container structure.
Figure 12:
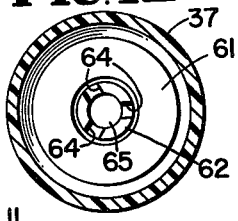
FIG. 12 is a section on line 12—12 of FIG. 10 affording a bottom plan view of the top closure of the container of FIG. 10 with the capsule removed and showing the capsule engaging formations.
Figure 13:
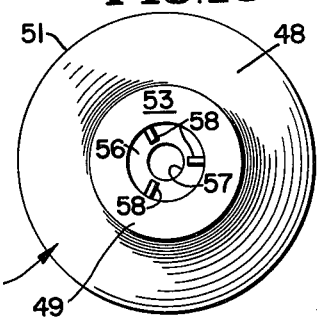
FIG. 13 is a top view of the capsule of FIG. 10.

Referring now to FIG. 10, the container comprises a body 35 with side walls tapering from the base toward a smaller diameter externally threaded neck portion indicated at 36, and a top closure 37 having side walls tapering upwardly from an internally threaded cylindrical section 38 toward an upper applicator or dispenser mounting portion 39.

A cradle 41 having a cylindrical wall 42 slidably fitting within neck 36 has an external flat integral annular lip 43 around its upper and extending over and seated upon the upper edge of the body neck so that cradle 41 is effectively firmly suspended and supported within the open upper end of the container body.

An integral internal annular ledge 44 is formed on the lower end of cradle 41 and this ledge is provided with a plurality of upwardly sharp pointed projections 45 that serve in the assembly to puncture the bottom wall of the capsule as will appear. Apart from the projections 45, the upper surface of ledge 44 lies in a plane extending at right angles to the container body axis and a predetermined distance below the plane of the edge of neck 36 upon which lip 43 is seated.

A capsule 46 of novel construction is shown in assembly in the container in FIG. 10. Capsule 46 has a lower cylindrical section 47 and an upper section 48 that decreasingly tapers correspondingly with the tapered side wall of closure 37 to a top wall 39. The outer cylindrical surface 51 slides freely within the cylindrical cradle to rest on ledge 44.

The lower end of capsule 46 is closed by a frangible bottom wall 52 that is preferably a sheet of relatively thin synthetic plastic bonded peripherally around the lower edges of cylindrical section 47. Wall 52 is planar and parallel to the flat planar top surface 53 of wall 49 and perpendicular to the central vertical axis of the capsule. The capsule walls at 47, 48 and 49 are stiff and relatively resistant to collapse, and may be integrally bonded synthetic plastic elements. Wall 52 on the other hand is readily punctured as by projections 45 as will appear.

The capsule side wall at 47, 48 is considerably thicker and materially more rigid than the deliberately frangible bottom wall 52. Preferably the capsule side wall is an integral stiff plastic annulus of polyethylene or the like that is longitudinally non-deformable and substantially non-deformable laterally, and is also hard enough to be considerably resistant to puncturing even by a sharp point. The capsule is capable of retaining its original shape under all operative conditions including the condition wherein it may be contacted by the rotating closure cap and forced toward the projections that rupture the bottom wall. The bottom wall 52 is preferably a flexible sheet of substantially film thickness polyethylene or the like so as to be readilly punctured and torn but strong enough not to sag appreciably due to the weight of the contents of the capsule.

Figure 14:
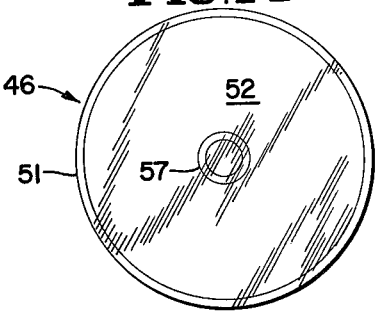
FIG. 14 is a bottom view of the capsule of FIG. 10.

A shallow well is centrally formed in top wall 49 and it comprises a cylindrical collar 54 depending from a central circular opening 55 in wall 49 and an internal annular ledge 56. A small diameter tube 57 extends from ledge 56 down through the center of the capsule to terminate in sealed contact with bottom wall 52 before the capsule is inserted into the container, as shown in FIG. 14. The collar 54 and tube 57 are preferably of the same stiff plastic as the side walls and may be integral therewith.

Within the well a plurality of three rigid radial projections 58 are provided, preferably extending the depth of the well but not above wall 49. Also since tube 57 provides a guide or passageway for a dip tube when the closure mounts a pump or the like as shown in FIG. 10, the projections 58 do not extend radially beyond the inner diameter of tube 57.

The foregoing capsule structure provides a capsule that is uniform about the indicated vertical centerline, and it encloses an annular chamber 59 which is filled with the concentrated detergent that is to be combined with the water or other liquid in the body of the container when the parts are assembled as in FIG. 10.

An annular fixed internal ledge 61 which in the illustrated embodiment may be the base of a spray pump is fixed within the upper part of closure 37, and a fixed sleeve 62 projects down from or through the ledge 61 to terminate in a toothed or serrated lower end. The spray pump and associated dip tube may for example be of the type disclosed in Tyler U.S. Pat. No. 3,061,202. In the illustrated form sleeve 62 is of a diameter to extend slidably into the well at the top of the capsule and the lower edge of the sleeve has slots 64 spaced and sized to fit with capsule projections 58 as will appear.

In use the container closure 37 is unscrewed and removed from the body and the sealed filled capsule 46 is slidably inserted into the cradle 41, the bottom wall of the capsule initially resting approximately on the projections 45. The cylindrical wall 47 of the capsule is of such length that it projects well out of the open end of the container body as shown. The closure assembly, complete with the pump and a fixed dip tube 65 projecting down from the pump is now mounted on the body. Dip tube 65 is thrust through the central passageway of the capsule and as it descends it ruptures the central part of wall 52. In some forms the wall 52 may be annular, that is it does not cover the passage through tube 57. The dimensions are such that as the closure is being rotated on the threads of the body neck the external tapered periphery of the capsule is rotatably slidably engaged by the smooth interior of the tapered closure side wall to urge the capsule into the container, and sleeve 62 enters the capsule well for non-rotatable coupling with the capsule projections.

Now as closure 37 is further turned to tight condition on the container body its engagement with the capsule forces the capsule deeper into the cradle toward puncturing association with projections 45, and at the same time the capsule is rotated so that a tearing or slicing action is effected on wall 52 to ensure that frangible wall 52 is ruptured or broken open sufficiently to dump all of the capsule contents into the water or other liquid in the container body.

The container, complete apart from the capsule, may be marketed separately, and the capsules are available for refills for original containers.

Figure 15:
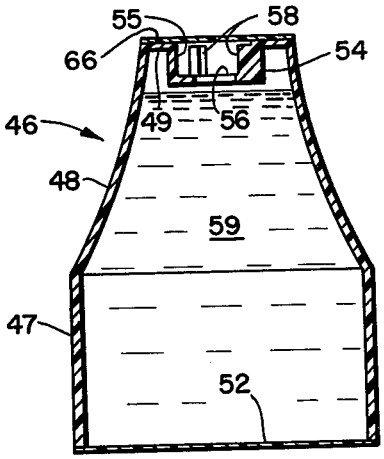
FIG. 15 is an elevation in section showing another form of capsule.

Referring to FIG. 15 a related form of capsule is shown that is usable where the container may be of the squeeze bottle type, for example a body 35 having flexible walls and the upper end of closure 37 being provided with an applicator aperture rather than the pump assembly.

The capsule of FIG. 15 differs from that of FIG. 10 in that the passageway forming tube 57 is omitted since there is no dip tube in the closure assembly. The combined translatory and rotary movements imparted to the capsule by the closure are the same as in the prior embodiment, so that the bottom of the capsule is effectively destroyed for escape of its contents to the body of the container.

When the capsule of FIG. 15 is apart from the container a frangible or removable strip 66 of pressure sensitive sealing tape or the like covers the top of the wall to close the capsule until the same time of use. This strip may be removed or punctured by sleeve 62 and it offers no resistance to entry of sleeve 62 to couple with the capsule during assembly.

The association of parts shown in FIGS. 10 and 15 enables the use of capsules containing relatively large amounts of concentrate or the like without sacrificing space within the container because a major volume of the capsule is disposed within the cap.

The assembly is ready for use without the operator risking contact with the concentrated liquid. When the contents of the container are exhausted, the closure 37 is taken off, the spent capsule removed, the container body refilled with water, a fresh capsule introduced into the cradle and the closure screwed back on the body as in initial assembly.

Referring now to FIGS. 16 and 17, the container 70 which is preferably of the squeeze bottle plastic type has the upper edge of the open or neck end 71 formed with a shoulder 72 supporting a cradle 73 that descends within the neck of the container and is formed with a bottom annular ledge 74 provided with upwardly extending sharp projections 75. Cradle 73 has an annular lip 76 seated in shoulder 72 and preferably sealingly secured therein so that there is no leakage of the container contents. Above ledge 74 the cradle is provided with internal screw threads 76.

The capsule here 77 is a relatively stiff-walled element having a lower cylindrical section 78 formed around its lower portion with external screw threads 79 that interfit with cradle threads 76, so that the capsule may be removably rotatably mounted on the container. Capsule 77 has a stiff non-deformable side wall and a frangible bottom wall 81 as in the earlier described capsules of FIGS. 10–15.

As shown the capsule is provided with one or more light or flexible external projections 82 that serve to sensibly signal when the capsule being installed in assembly has been displaced to an initial position wherein its frangible bottom wall is just above the projections 75. Similarly the outer wall of the capsule may have an indicator line 83 to visually signal this desired initial position.

In this initial position the capsule acts to close the top of the container. As in the other embodiments the capsule may contain a concentrate. Thus when a customer desires to first use the assembly the capsule is rotatably unscrewed and removed to allow water or other liquid to be placed in the container, and then the capsule is replaced and rotated on the cradle until the frangible bottom wall is punctured by the projections 75 and the concentrate dumps into the container liquid. In this phase of operation the capsule will be forced to the signal point.

After the concentrate has been delivered into the container liquid, the normally closed integral dispensing tip 84 at the upper end of the capsule is opened as by clipping and the container contents may be dispensed through the opening as by squeezing the container body.

All during dispensing of the liquid mixture in the container and between dispensing operations, the capsule serves as a closure for the container, the fit of the threads at 76, 77 being such as to provide an effective leak seal.

The invention provides an advantageous, inexpensive, safe and easy to use container-dispenser for combining and dispensing two or more components of a multi-component system before use. The container or bottle is reusable and the capsules are easily removed and replaced when exhausted. The bottle need only be purchased once and various types of dispensing means such as the hand pump and squirt nozzle shown and described may be used therewith.

The foregoing description is directed to various preferred embodiments of the invention and shall not be deemed limiting of the invention, the full scope of which is defined by the following claims.

What is claimed and desired to be secured by Letters Patent is:

1. A package for diluting and dispensing in diluted form a concentrated substance comprising in combination, a. a hollow container having a neck portion terminating in an annular rim, b. a closure cap having an inner threaded surface, c. said neck portion having an outer threaded surface adapted for rotatable connection with said inner threaded surface of said cap to mount the cap on said container, d. a cradle disposed in said neck portion below said annular rim, e. a sealed capsule containing said substance mounted on said cradle with its bottom wall seated on said cradle, said capsule having a relatively stiff shape retaining side wall projecting upwardly through said neck portion within said cap and a top wall provided with coupling formations, f. puncturing means on said cradle projecting from said cradle toward said annular rim and terminating below said open end, g. downwardly extending coupling formations within said cap adapted to engage said coupling formations on the capsule as the cap is rotated while being mounted on said container, and h. dispensing means disposed in said closure cap for expelling the contents of said container, i. said puncturing means being adapted to pierce the bottom wall of said capsule as the capsule is displaced in response to downward movement and rotation of said closure cap on said neck portion of the container, thereby releasing said concentrated substance into said hollow container.

2. A package for diluting and dispensing in diluted form a concentrated substance comprising in combination, a. a hollow container having a neck portion terminating in an annular rim, b. a closure cap having a tapered upper end mounting a dispensing device and having an inner threaded surface at its lower end, c. said neck portion having an outer threaded surface adapted for rotatable connection with said inner threaded surface of said cap to mount the cap on said container, d. a cradle disposed in said neck portion below said annular rim, e. a sealed capsule containing said substance mounted on said cradle with its bottom wall seated on said cradle, said capsule having a relatively stiff shape retaining side wall and projecting upwardly through said neck portion into said cap whereby to dispose a major part of the volume of said capsule within the cap above said rim, and f. puncturing means on said cradle projecting from said cradle toward said annular rim and terminating below said open end, g. said puncturing means being adapted to pierce the bottom wall of said capsule in response to downward movement and rotation of said closure cap on said neck portion of the container, thereby releasing said concentrated substance into said hollow container, said closure cap during rotation while being mounted on said container engaging said capsule and displacing it toward said puncturing means.

3. A package for diluting and dispensing in diluted form a concentrated substance comprising in combination, a. a hollow container having a neck portion, b. means within said neck portion providing an internally threaded section and below that at least one upwardly extending puncturing projection, and c. a sealed capsule containing said substance having a stiff shape-retaining side wall, a top wall provided with a dispensing outlet and a relatively frangible bottom wall, d. the lower end of the capsule side wall being threaded for mounting the capsule on the container neck portion whereby the capsule serves as a closure for the container, e. and said puncturing means being adapted to pierce the bottom wall of said capsule in response to predetermined movement of the capsule toward the interior of the container, thereby releasing said concentrated substance into said hollow container, whereby after said frangible wall is punctured and the substance in the capsule has been mixed with material in the container the mixture may be dispensed through said dispensing outlet.

4. A package as defined in claim 3, wherein an indicator is provided on said capsule for indicating when it has been mounted in closure forming condition on said neck portion with its bottom wall above sai puncturing projection.

5. The package defined in claim 3, wherein said container is of the squeeze bottle type and said capsule is formed at its upper end with an initially closed dispensing tip providing said outlet.

6. A package for diluting and dispensing in diluted form a concentrated substance comprising in combination, a. a hollow container having a neck portion, b. a cradle depending within said neck portion providing an internally threaded section and below that at least one upwardly extending puncturing projection, and c. a sealed capsule containing said substance having a stiff shape-retaining side wall and a relatively frangible bottom wall, d. the lower end of the capsule side wall being threaded for mounting the capsule on said internally threaded cradle section and e. said puncturing projection being adapted to pierce the bottom wall of said capsule in response to predetermined movement of the capsule toward the interior of the container, thereby releasing said concentrated substance to said hollow container.

7. A package for diluting and dispensing in diluted form a concentrated substance comprising in combination, a. a hollow container having a neck portion terminating in an annular rim;

b. a closure cap rotatably mounted on said neck portion;

c. a cradle disposed in said neck portion below said annular rim;

d. a sealed capsule containing said substance mounted on said cradle with a frangible bottom wall seated in said cradle, said capsule having a longitudinally stiff shape retaining side wall projecting upwardly through said neck portion within said cap and a top provided with coupling formations for engagement with interacting formations on said closure cap;

e. means on said cradle for puncturing the capsule bottom wall projecting from said cradle toward said annular rim and terminating below said open end;

f. cooperating means on said cap and capsule to displace the capsule toward said puncturing means when the cap is rotated;

g. dispensing means disposed in said closure cap for expelling the contents of said container; and h. said puncturing means being adapted to pierce the bottom wall of said capsule as the capsule is displaced downwardly in response to rotation of said closure cap on said neck portion of the container, thereby releasing said concentrated substance into said hollow container.

8. A package for diluting and dispensing in diluted form a concentrated substance comprising in combination, a. a hollow container having a neck portion terminating in an annular rim;

b. a closure cap rotatably mounted on said neck portion;

c. a cradle disposed in said neck portion below said annular rim;

d. a sealed capsule containing said substance mounted on said cradle with a frangible bottom wall seated in said cradle, said capsule having a longitudinally stiff shape retaining side wall projecting upwardly through said neck portion within said cap;

e. means on said cradle for puncturing the capsule bottom wall projecting from said cradle toward said annular rim and terminating below said open end;

f. cooperating means on said cap and capsule to displace the capsule toward said puncturing means when the cap is rotated;

g. dispensing means disposed in said closure cap for expelling the contents of said container; and h. said puncturing means being adapted to pierce the bottom wall of said capsule as the capsule is displaced downwardly in response to rotation of said closure cap on said neck portion of the container, thereby releasing said concentrated substance into said hollow container.

* * * * *

UNITED STATES PATENT OFFICE

CERTIFICATE OF CORRECTION

Patent No. 4,088,246 Dated May 9, 1978

Inventor(s) Richard James Klingaman

It is certified that error appears in the above-identified patent and that said Letters Patent are hereby corrected as shown below:

Column 3, line 56, change "can" to --cap--.

Column 7, line 60, delete "same".

Column 10, line 30, change "sai" to --said--.

Column 10, line 54, change "to" to --into--.

Column 10, line 68, after "top" insert --wall--.

Signed and Sealed this

*Twenty-first* Day of *November 1978*

[SEAL]

*Attest:*

RUTH C. MASON
*Attesting Officer*

DONALD W. BANNER
*Commissioner of Patents and Trademarks*